US011878770B2

(12) United States Patent
Irving et al.

(10) Patent No.: US 11,878,770 B2
(45) Date of Patent: Jan. 23, 2024

(54) BATTERY OPERATED SMALL CRAFT BILGE PUMP

(71) Applicant: Flow Control LLC, Gloucester, MA (US)

(72) Inventors: Michael H. Irving, Haverhill, MA (US); Joel A. Kenney, Beverly, MA (US)

(73) Assignee: FLOW CONTROL LLC, Beverly, MA (US)

( * ) Notice: Subject to any disclaimer, the term of this patent is extended or adjusted under 35 U.S.C. 154(b) by 140 days.

(21) Appl. No.: 13/709,492

(22) Filed: Dec. 10, 2012

(65) Prior Publication Data

US 2013/0145975 A1 Jun. 13, 2013

Related U.S. Application Data

(60) Provisional application No. 61/568,410, filed on Dec. 8, 2011.

(51) Int. Cl.
*B63B 13/00* (2006.01)

(52) U.S. Cl.
CPC ..... *B63B 13/00* (2013.01)

(58) Field of Classification Search
CPC ..... F04B 49/025; F04B 49/04; F04D 13/086; F04D 13/068; F04D 13/0693; F04D 13/08; B63B 13/00
USPC ..... 417/36, 40, 423.3; 114/183 R
See application file for complete search history.

(56) References Cited

U.S. PATENT DOCUMENTS 2,530,664 A 11/1950 Pye
2,669,934 A * 2/1954 Lovett, Jr. ..... F04D 13/086 417/40
3,316,845 A * 5/1967 Schumann ..... F04D 13/086 417/40

(Continued)

FOREIGN PATENT DOCUMENTS

JP 05131970 5/1993
WO 2010112214 10/2010

(Continued)

OTHER PUBLICATIONS

ITT, Rule Pump Model 24, 2008, pp. 1, 2, 21, 22 and 25.*
JP05131970 English Language Abstract (1 page).

*Primary Examiner* — Alexander B Comley
(74) *Attorney, Agent, or Firm* — Ware, Fressola, Maguire & Barber LLP

(57) ABSTRACT

A small lightweight battery operated remote switched bilge pump is provided weighing less than one pound for installing in a small watercraft, including a kayak, canoe, sailboat, row boat, dingy, featuring a bilge pump having a low voltage inline pump, a housing having a compartment with an integrated strainer base to receive the low voltage inline pump, and having a watertight compartment to receive lightweight batteries to power the bilge pump for about 1.5 hours, and a switch assembly to selectively operate on/off functionality of the bilge pump remotely; and a Velcro® arrangement to couple the bilge pump to a surface of the small watercraft to allow easy installation of the bilge pump in about 15 seconds to perform bilge pump functionality without drilling or making holes in the small watercraft, and to allow easy removal of the bilge pump for cleaning and battery replacement.

12 Claims, 3 Drawing Sheets

(56) References Cited

U.S. PATENT DOCUMENTS 3,776,666 A * 12/1973 Ludwig ..... F04B 53/00 417/413.1
3,941,073 A * 3/1976 Ridgeway ..... F04D 13/068 417/40
4,050,396 A * 9/1977 Ridgeway ..... B63B 13/00 417/40
4,084,530 A 4/1978 Harris et al.
4,218,195 A * 8/1980 Shure ..... F04D 13/068 417/423.3
4,275,995 A * 6/1981 Taylor ..... F04D 15/0218 417/40
4,326,478 A 4/1982 Holmes
4,331,883 A * 5/1982 Vitaloni ..... F04B 35/04 D13/110
4,502,515 A * 3/1985 Kobayashi ..... F04B 49/025 141/195
4,789,307 A * 12/1988 Sloan ..... F04B 53/00 417/40
5,094,591 A * 3/1992 Whitley, II ..... F04D 29/426 417/423.1
5,249,930 A * 10/1993 Pacquesi ..... F04D 13/086 417/313
5,419,271 A 5/1995 Tweet et al.
5,669,323 A * 9/1997 Pritchard ..... F04D 29/605 417/234
5,833,437 A * 11/1998 Kurth ..... F04D 13/086 417/372
5,950,555 A * 9/1999 Damask ..... B63B 34/20 417/550
6,170,423 B1 1/2001 Suganuma
6,290,469 B1 * 9/2001 Archibald ..... F04B 17/06 417/424.2
6,390,780 B1 * 5/2002 Batchelder ..... F04D 15/0236 417/18
6,447,261 B1 * 9/2002 McCook ..... F04B 17/06 417/234
6,469,641 B1 10/2002 Lash et al.
7,661,380 B2 2/2010 Waldecker
7,780,850 B2 4/2010 Clukies
7,841,286 B1 * 11/2010 Bochenski ..... B63J 4/00 114/183 R
2002/0176782 A1 11/2002 Batchelder et al.
2004/0131482 A1 * 7/2004 King ..... F04B 43/08 417/374
2005/0204464 A1 * 9/2005 Dotson ..... 4/496
2005/0244287 A1 * 11/2005 Dobrynski ..... F04B 17/03 417/423.3
2007/0023345 A1 2/2007 Westmoreland
2007/0048157 A1 * 3/2007 Collins ..... F04D 15/0218 417/423.3
2011/0288725 A1 * 11/2011 Yuter ..... 701/36
2011/0308441 A1 * 12/2011 Peloquin ..... F04B 17/03 114/343
2013/0052060 A1 * 2/2013 Meza ..... F04B 17/03 417/411

FOREIGN PATENT DOCUMENTS

WO WO 2010112214 A1 * 10/2010
WO 2011094010 8/2011

* cited by examiner

BATTERY OPERATED SMALL CRAFT BILGE PUMP

CROSS-REFERENCE TO RELATED APPLICATIONS

This application claims benefit to provisional patent application Ser. No. 61/568,410 (911-017.024-1//M-RLE-1103), filed 8 Dec. 2011, which is incorporated by reference in its entirety.

BACKGROUND OF THE INVENTION

1. Field of Invention

The present invention relates to a pump; and more particularly to a battery operated bilge pump.

2. Description of Related Art

A current prior art design consists of a standard 12 volt bilge pump, a separate battery case, water proof wire connections and an on/off switch.

The current design or version is heavy (about five pounds with battery), requires a lead acid battery, requires at least 3 holes drilled in the side of a kayak for wiring and a thruhull and installation takes about 2-4 hours on average with a $360.00 retail price. Typically, the battery life is about 45 minutes on a single charge.

In view of this, there is a longstanding need in the recreational boat industry and marketplace for a better bilge pump design that is easier to install, easier to remove, e.g., to replace the batteries, operates for a long period of time before the batteries need to be changed, and is less expensive in overall cost.

SUMMARY OF THE INVENTION

In summary, according to the present invention a small craft pump may be configured that uses a housing with an integrated strainer base to contain a 6 volt inline pump plus 5 or 6 AA batteries in one compartment with a switch assembly on a 3-4 foot wire cable to operate the pump. A Velcro® or Velcro-like material may be used to fasten the apparatus to an inside compartment wall of a kayak or other small rowing craft, unlike the current known models on the market which require screws or permanent glue. The Velcro® will allow the user to easily remove the pump for cleaning and battery replacement as well as making the apparatus very easy to install. The small craft pump according to the present invention may be configured to weigh under a pound with batteries, does not require any drilling of the vessel, can be installed in approximately 15 seconds and has a retail price under $70.00. Typical battery life is approximately 1.5 hours.

By way of example, and according to some embodiments, the present invention may include, or take the form of, an apparatus or arrangement, which includes such a small lightweight battery operated remotely switched bilge pump weighing less than about one pound for installing in such a small watercraft or vessel, including such a kayak, canoe, sailboat, row boat, dingy. The apparatus or arrangement may include a bilge pump arrangement in combination with a detachable coupling arrangement, such as Velcro, as follows:

The bilge pump arrangement may be configured with a pump, e.g., such a low voltage inline pump (like the iL200 Inline Pump), and a housing having two compartments, including a compartment having an integrated strainer base and configured to receive the low voltage inline pump, and including a watertight compartment configured to receive lightweight batteries to power the low voltage inline pump.

The apparatus or arrangement may also include a switch assembly that may be configured to selectively operate the on/off functionality of the low voltage inline pump. For example, the switch assembly may be configured on, e.g., a 3-4 foot wire physically connected to the bilge pump arrangement to operate the on/off functionality of the pump remotely. Alternatively, embodiments are envisioned in which the switch assembly may be configured to be arranged in the watertight compartment of the housing and the on/off functionality controlled via wireless remote control, e.g., via a remote wireless transmitter.

The detachable coupling arrangement, including Velcro®, may be configured to detachably couple the bilge pump arrangement to a surface of the kayak or other small watercraft so as to allow installation of the bilge pump arrangement to perform bilge pump functionality without the need for drilling or making any hole in any surface of the kayak or other small watercraft, and also to allow removal of the bilge pump arrangement for cleaning and battery replacement.

The apparatus or arrangement may include one or more of the following features:

The detachable coupling arrangement may include one Velcro® piece having hooks, and another Velcro® piece having loops for detachably coupling to the hooks.

The surface of the kayak or other small watercraft may include inner part or portion of a hull or other surface at a location at or near where water leaking into the small watercraft or vessel is likely to collect and need to be bilged from the vessel.

Furthermore, by way of example, and according to some embodiments, the present invention may include, or take the form of, a kit for installing such a bilge pump arrangement having such a small lightweight battery operated remote switched bilge pump in such a small watercraft or vessel, including a kayak, canoe, sailboat, row boat, dingy, including such a bilge pump arrangement in combination with such a Velcro® arrangement.

In addition to the features set forth above, the kit may include one or more of the following features:

The kit may further include lightweight batteries, including 5-6 A, AA, AAA batteries configured to provide, e.g., about 6 volts, in order to power the pump.

The kit may further include an instruction sheet with instructions for coupling the pump to the boat hull with the Velcro, replacing the batteries, remotely switching the pump on/off, etc.

The battery operated small craft bilge pump according to the present invention satisfies the aforementioned longstanding need in the recreational boat and small craft industry and marketplace and provides a new, unique and better bilge pump design that is easier to install, easier to remove, e.g., to replace the batteries, operates for a long period of time before the batteries need to be changed, and is less expensive in overall cost, all in relation to the bilge pumps that are known in the art.

BRIEF DESCRIPTION OF THE DRAWING

The drawing includes FIGS. 1-4, which are not necessarily drawn to scale, as follows.

DETAILED DESCRIPTION OF BEST MODE OF THE INVENTION

FIG. 1: The Basic Apparatus or Arrangement 10

By way of example, FIG. 1 show an apparatus or arrangement generally indicated as 10 in the form of a bilge pump arrangement generally indicated as 11, which includes a small lightweight battery operated remotely switched bilge pump.

Figure 1B:
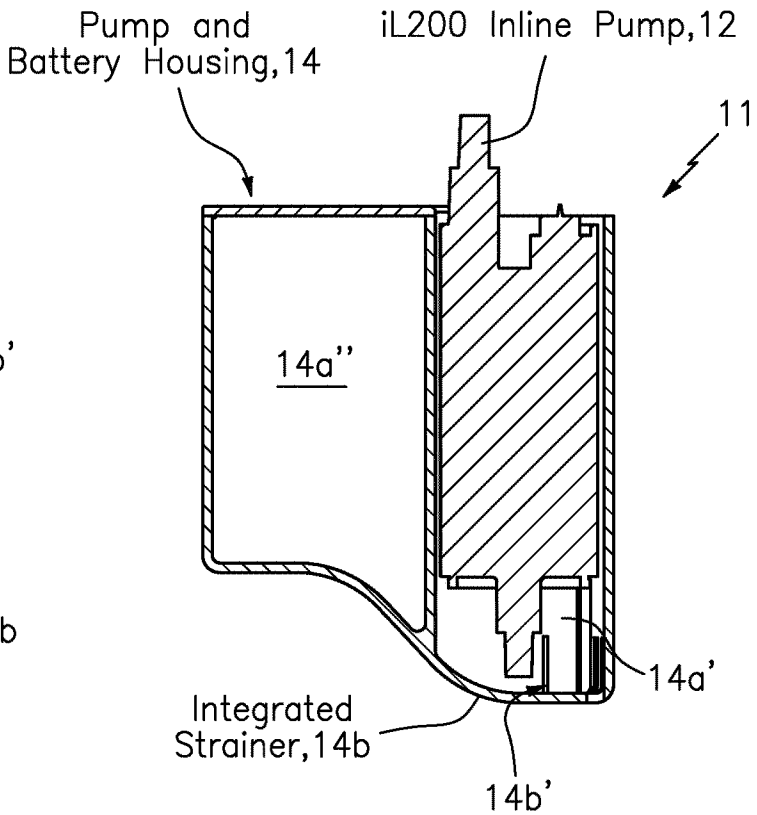
FIG. 1 includes FIGS. 1*a* and 1*b*, which are diagrams of a bilge pump arrangement, according to some embodiments of the present invention.
Figure 1A:
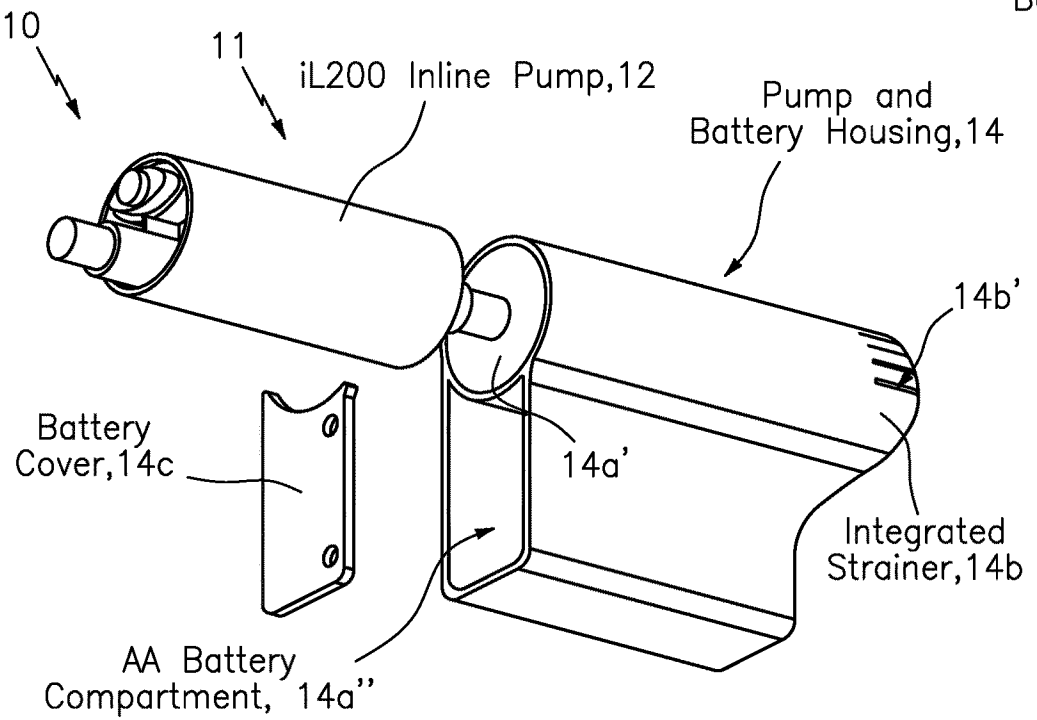

In FIGS. 1*a*, 1*b*, the bilge pump arrangement 11 may be configured with, or include a pump 12, e.g., such as a low voltage inline pump, and a housing 14, as shown. The housing 14 has two compartments 14*a*', 14*a*", including a compartment 14*a*' having an integrated strainer base 14*b* and configured to receive the low voltage inline pump 12, and also including a watertight compartment 14*a*" configured to receive lightweight batteries (not shown) to power the low voltage inline pump 12. The integrated strainer base 14b is configured with passageways 14*b*' to allow water to pass into the compartment 14*a*' to be pumped. The integrated strainer base 14*b* may also be configured, e.g., with a screen, to prevent certain sized particulate in the water from passing into the compartment 1i a'.

The bilge pump arrangement 11 also includes a removable battery cover 14 that may be removed from the housing 14, including by unscrewing one or more screws (not shown), in order to replace the batteries 22'. The removable battery cover 14 may also include a sealing gasket (not shown) for providing a watertight seal between the removable battery cover 14 and the rim of the battery compartment 14" to which it is coupled. Sealing gaskets are known in the art, and the scope of the invention is not intended to be limited to any particular type or kind thereof, either now known or later developed in the future. The bilge pump arrangement 11 also includes suitable hosing and hosing couplings to pump the water from the pump, e.g., out of the small craft or vessel.

Figure 2:
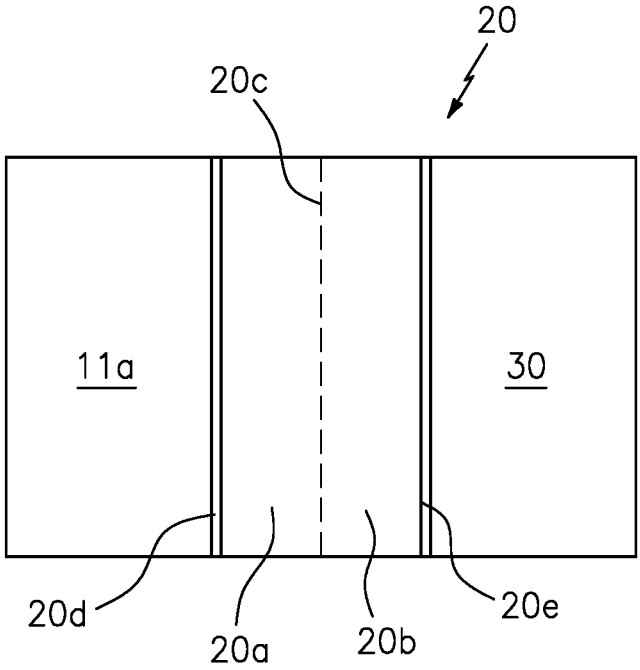
FIG. 2 is a block diagram of a detachable coupling arrangement, such as Velcro®, for coupling part of a boat hull to part of the bilge pump arrangement shown in FIG. 1, according to some embodiments of the present invention.

The apparatus or arrangement 10 also includes a detachable coupling arrangement generally indicated as 20 shown in FIG. 2 that may be configured to detachably couple part 11*a* of the bilge pump arrangement 11 to a surface or part 30 of the small watercraft or vessel so as to allow installation of the bilge pump arrangement 11 to perform bilge pump functionality without the drilling or making of any hole in any part or surface of the small watercraft or vessel, and also to allow removal of the bilge pump arrangement 11 for cleaning and battery replacement.

By way of example, the detachable coupling arrangement 20, such as Velcro®, may include a one Velcro® piece 20*a* having hooks, and another Velcro® piece 20*b* having loops for detachably coupling to the hooks. The dashed lines indicated by reference label 20*c* represent the hook and loop coupling interface between the two Velcro® pieces 20*a* and 20*b*. The Velcro® piece 20*a* has an adhesive backing and is attached to the part 11*a* of the bilge pump arrangement 11 with an adhesive 20*d* when an adhesive covering (not shown) is removed from the Velcro® piece 20*a*, consistent with that known in the art. Similarly, the Velcro® piece 20*b* also has an adhesive backing and is attached to the part 30 of the small watercraft or vessel with an adhesive 20*e* when an adhesive covering (not shown) is removed from the Velcro® piece 20*b*, consistent with that known in the art. As a person skilled in the art would appreciate, the adhesive coupling between the Velcro® piece 20*a* and the part 11*a* of the bilge pump arrangement 11, as well as the adhesive coupling between the Velcro® piece 20*b* and the part 30 of the small watercraft or vessel with an adhesive 20*e*, is intended to be substantially stronger than the hook and loop coupling interface, so that the Velcro® pieces 20*a* and 20*b* remain attached to the part 11*a* and the part 30 when the hook and loop coupling interface between the two Velcro® pieces 20*a* and 20*b* is broken and the bilge pump arrangement 11 is removed, e.g., to clean or replace the batteries. The adhesive coupling between the Velcro® piece 20*a* and the part 11*a* of the bilge pump arrangement 11, as well as the adhesive coupling between the Velcro® piece 20*b* and the part 30 of the small watercraft or vessel with an adhesive 20*e*, is also intended to be substantially water resistant, including resistant to both fresh water and sea water. The scope of the invention is not intended to be limited to any particular type or kind of Velcro® either now known or later developed in the future, including Velcro® used for residential household use, as well as industrial strength Velcro®. Moreover, the scope of the invention is intended to include other types or kinds of detachable coupling arrangements either now known or later developed in the future.

Figure 3:
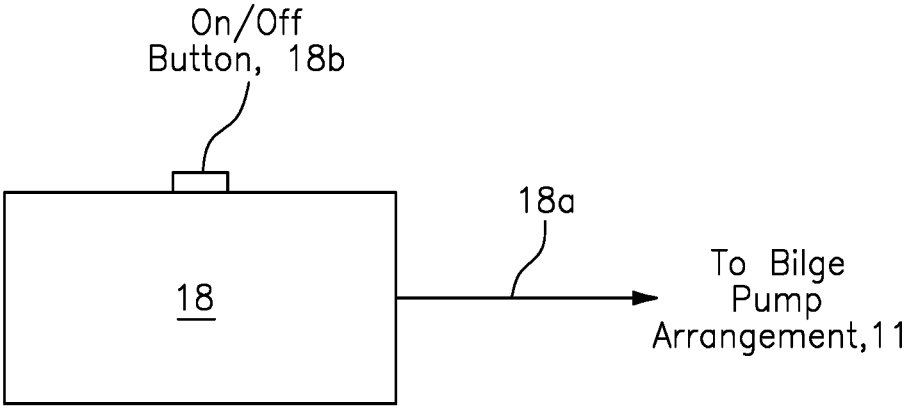
FIG. 3 is a block diagram of a switching assembly configured to selectively operate on/off functionality of a pump remotely, according to some embodiments of the present invention.

FIG. 3: The Switching Assembly 18

The apparatus or arrangement 10 may include a switch assembly 18 that may be configured to selectively operate the on/off functionality of the pump 12. For example, the switch assembly 18 may be configured or tethered on, e.g., about a 3-4foot wire 18*a*, and coupled in a watertight manner, e.g., through the housing 14, to the pump 12 in bilge pump arrangement 11 in order to operate the on/off functionality of the pump 12 remotely by the boater. The switch assembly 18 may also be configured as a watertight device, e.g., including an on/off button 18*b* that may take the form of a toggle switch that may be pressed, or a capacitive touch control that may be touched, etc.

Figure 4:
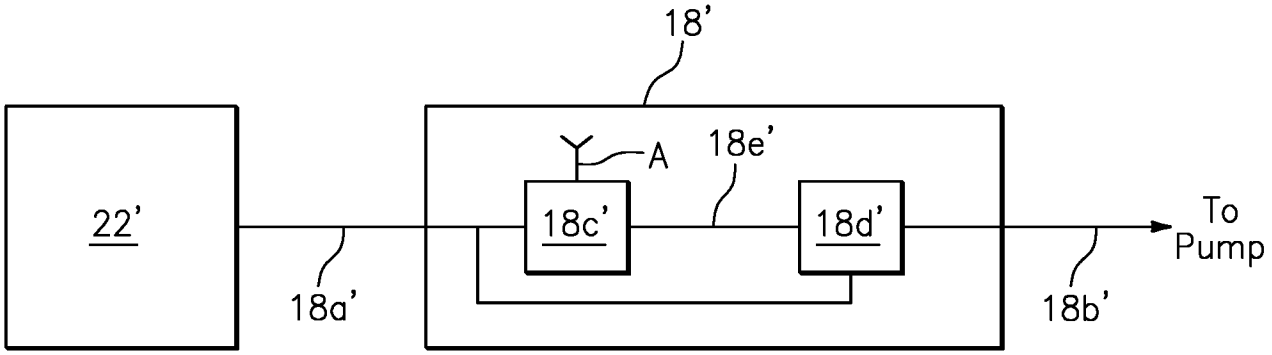
FIG. 4 is a block diagram of a wireless switching assembly configured to be arranged in a housing of the bilge pump arrangement and selectively operate on/off functionality of the pump, according to some embodiments of the present invention.

FIG. 4: Alternative Embodiment

FIG. 4 shows an alternative embodiment, wherein the apparatus or arrangement 10 may include a wireless switching assembly 18' that may be configured to be arranged in the watertight compartment 14*a*" of the housing 14 to selectively operate the on/off functionality of the low voltage inline pump 12 via a wireless remote arrangement, including a wireless transmitter (not shown). In FIG. 4, the wireless switching assembly 18' may be configured with a wireless receiver module 18*c*' and a control module 18*d*' that receive power from the batteries 22' via wiring 18*a*'. The wireless receiver module 18*c*' may be configured with an antenna part or portion like element A for receiving a wireless control signal, e.g., from the wireless transmitter (not shown) and for providing a control signal to the control module 18*d*'. The control module 18*d*' may be configured to receive the control signal via line 18*e*' and provide control signalling via line 18*b*' to turn the pump 12 (FIG. 1) on/off. Wireless receiver modules like element 18*c*' and control modules like element 18*d*' are known in the art, and the scope of the invention is not intended to be limited to any particular type or kind thereof either now known or later developed in the future. The scope of the invention is also not intended to be limited to embodiments based on wireless remote communication.

The Compartments 14

By way of example, the housing 14, the compartment 14*a*' and the watertight compartment 14*a*" may be configured and dimensioned with a particular size, shape and contour. The compartment 14*a*' may be configured with a respective size, shape and contour so as to receive and contain the pump 12, which itself has a corresponding size, shape or contour. As shown, the compartment 14*a*' and the pump 12 have substantially corresponding cylindrical shapes and contours. Similarly, the watertight compartment 14*a*" may be configured with a respective size, shape and contour so as to receive and contain the batteries (not shown), or alternatively, the batteries 22' and the switch assembly 18' (see FIG. 4).

The compartment 14*a*' and the watertight compartment 14*a*" may be coupled by a watertight passageway (not shown) so as to allow wiring from the batteries in the watertight compartment 14*a*" to pass through and connect to the pump 12. As a person skilled in the art would appreciate, a watertight grommet may be used to provide such a watertight passageway for the wiring.

In the alternative embodiment shown in relation to FIG. 4 the batteries 22' may be arrangement in a battery cartridge that is coupled to the switch assembly 18' via wiring 18*a*'. The compartment 14*a*' and the watertight compartment 14*a*" may be coupled by a watertight passageway (not shown) so as to allow the wiring 18*b*' from the switch assembly 18' to pass through and connect to the pump 12. As a person skilled in the art would appreciate, a watertight grommet may be used to provide such a watertight passageway for the wiring 18*b*'.

The two compartments 14*a*' and 14*a*" are configured as adjoining compartments that share a common wall 15, e.g., consistent with that shown in FIG. 1. The common wall 15 is also configured as a curved wall, e.g., consistent with that also shown in FIG. 1*a*.

The Kit

By way of example, and according to some embodiments, the present invention may include, or take the form of, a kit for installing the bilge pump arrangement 11 to some part or surface of a small craft or vessel using the detachable coupling arrangement 20, such as Velcro, consistent with that disclosed herein.

By way of example, the kit may include the following:

the bilge pump arrangement 11;

the detachable coupling arrangement 20, such as Velcro®;

a switch assembly, including a tethered switch assembly or a wireless switching assembly and a wireless transmitter;

batteries 22'; and an instruction sheet with instructions for coupling the pump to the boat hull with the Velcro, replacing the batteries, remotely switching the pump on/off, etc.

Such a kit would allow a consumer, e.g. including a non-sophisticated boat owner, to purchase everything that is needed in one kit or package and be able to very easily, inexpensively and safely install such a small lightweight battery operated remotely switched bilge pump weighing less than about one pound in such a small watercraft or vessel, including such a kayak, canoe, sailboat, row boat, dingy.

As a person skilled in the art would appreciate, Velcro® is understood to be a closure consisting of a piece of fabric of small hooks that sticks to a corresponding fabric of small loops.

APPLICATIONS

The present invention may also be used in, or form part of, or used in conjunction with, the following pumps:

Kayak bilge pump,

Canoe bilge pump,

Small craft (sailboat, row boat, dingy etc.) bilge pump,

Water cooler pump,

Static bait well water removal, and

Window well water removal.

THE SCOPE OF THE INVENTION

While the invention has been described with reference to an exemplary embodiment, it will be understood by those skilled in the art that various changes may be made and equivalents may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A remotely switched bilge pump for arranging in a kayak or other watercraft having an inner part or portion of a hull or other surface at a location where water leaks into the kayak or other watercraft, comprising:

a bilge pump arrangement having an inline pump, a replaceable battery cover and a combined pump and battery housing molded in a single piece and that has a common wall separating a pump compartment and a watertight battery compartment, the pump compartment configured to contain the inline pump therein and having an integrated strainer base with passageways to allow water to pass into and flood the pump compartment so as to form a flooded pump compartment to be pumped, the watertight battery compartment configured to contain batteries to power the inline pump contained in the pump compartment, the replaceable battery cover configured to provide a watertight seal with a rim of the watertight battery compartment and be removed from the combined pump and battery housing to replace the batteries contained therein;

a remote switch assembly configured to couple to the bilge pump arrangement and selectively operate on/off functionality of the inline pump remotely from the bilge pump arrangement; and a detachable coupling arrangement configured to couple and attach the bilge pump arrangement to the inner part or portion of the hull or other surface of the kayak or other watercraft so as to allow installation of the bilge pump arrangement to perform bilge pump functionality without the need for drilling or making any hole in any surface of the kayak or other watercraft, and also to allow removal of the bilge pump arrangement for cleaning and battery replacement; wherein the pump compartment comprises a single and separate pump compartment, and the watertight battery compartment comprises a single and separate watertight battery compartment;

the single and separate pump compartment is configured to contain separately the inline pump therein, and does not contain the batteries to power the inline pump; and the single and separate watertight battery compartment is configured to contain separately the batteries to power the inline pump and does not contain the inline pump.

2. The remotely switched bilge pump according to claim 1, wherein the remote switch assembly is configured on a wire and coupled to the bilge pump arrangement and has an on/off button to operate the on/off functionality of the inline pump remotely.

3. The remotely switched bilge pump according to claim 1, wherein the remote switch assembly is configured to operate the on/off functionality of the inline pump wirelessly.

4. The remotely switched bilge pump according to claim 1, wherein the detachable coupling arrangement comprises one piece having hooks, and another piece having loops for coupling to the hooks.

5. The remotely switched bilge pump according to claim 1, wherein the remotely switched bilge pump weighs less than one pound for installing in the kayak or the watercraft.

6. The remotely switched bilge pump according to claim 1, wherein the inline pump is dimensioned with a predetermined inline pump size, shape or contour;

the batteries are dimensioned with a predetermined battery size, shape or contour;

the pump compartment is configured with an associated predetermined pump compartment size, shape or contour that substantially corresponds to the predetermined inline pump size, shape or contour in order to arrange the inline pump therein; and the watertight battery compartment is configured with an associated predetermined battery compartment size, shape or contour that substantially corresponds to the predetermined battery size, shape or contour in order to receive the batteries to power the inline pump.

7. The remotely switched bilge pump according to claim 1, wherein the remotely switched bilge pump comprises a wireless switch assembly arranged in the watertight battery compartment to selectively operate the on/off functionality of the inline pump in response to a wireless signal provided by the remote switch assembly.

8. The remotely switched bilge pump according to claim 1, wherein the detachable coupling arrangement is a closure consisting of a piece of fabric of hooks that sticks to a corresponding fabric of loops.

9. A battery operated remotely switched bilge pump for arranging in a kayak or other watercraft having an inner part or portion of a hull or other surface at a location where water leaks into the kayak or other watercraft, comprising:

a bilge pump arrangement having an inline pump, a replaceable battery cover, one or more batteries and a combined pump and battery housing molded in a single piece and that has a common wall separating a pump compartment and a watertight battery compartment, the pump compartment configured to contain the inline pump therein and having an integrated strainer base with passageways to allow water to pass into and flood the pump compartment so as to form a flooded pump compartment to be pumped, the watertight battery compartment configured to contain the one or more batteries to power the inline pump contained in the pump compartment, the replaceable battery cover configured to provide a watertight seal with a rim of the watertight battery compartment and be removed from the combined pump and battery housing to replace the one or more batteries contained therein;

a remote switch assembly configured to couple to the bilge pump arrangement and selectively operate on/off functionality of the inline pump remotely from the bilge pump arrangement; and a detachable coupling arrangement configured to couple and attach the bilge pump arrangement to the inner part or portion of the hull or other surface of the kayak or other watercraft so as to allow installation of the bilge pump arrangement to perform bilge pump functionality without the need for drilling or making any hole in any surface of the kayak or other watercraft, and also to allow removal of the bilge pump arrangement for cleaning and battery replacement; wherein the pump compartment comprises a single and separate pump compartment, and the watertight battery compartment comprises a single and separate watertight battery compartment;

the single and separate pump compartment is configured to contain the inline pump therein, and does not contain the one or more batteries to power the inline pump; and the single and separate watertight battery compartment is configured to contain the one or more batteries to power the inline pump and does not contain the inline pump.

10. The battery operated remotely switched bilge pump according to claim 9, wherein the remote switch assembly is configured on a wire and coupled to the bilge pump arrangement and has an on/off button to operate the on/off functionality of the pump remotely.

11. The battery operated remotely switched bilge pump according to claim 9, wherein the battery operated remotely switched bilge pump comprises a wireless switch assembly arranged in the watertight battery compartment to selectively operate the on/off functionality of the inline pump in response to a wireless signal provided by the remote switch assembly.

12. The battery operated remotely switched bilge pump according to claim 9, wherein the inline pump is dimensioned with a predetermined inline pump size, shape or contour, the pump compartment is configured with an associated predetermined pump compartment size, shape or contour that substantially corresponds to the predetermined inline pump size, shape or contour in order to arrange the inline pump therein, and the inline pump and the pump compartment have corresponding cylindrical shapes.

* * * * *